US006244930B1

(12) United States Patent
Archilla

(10) Patent No.: US 6,244,930 B1
(45) Date of Patent: Jun. 12, 2001

(54) METHOD AND APPARATUS FOR CENTERLESS GRINDING

(75) Inventor: Louis E. Archilla, Lakewood, CO (US)

(73) Assignee: Star Guide Corporation, Aryada, CO (US)

( * ) Notice: Subject to any disclaimer, the term of this patent is extended or adjusted under 35 U.S.C. 154(b) by 0 days.

(21) Appl. No.: 09/308,737

(22) PCT Filed: Nov. 26, 1997

(86) PCT No.: PCT/US97/21593

§ 371 Date: May 24, 1999

§ 102(e) Date: May 24, 1999

(87) PCT Pub. No.: WO98/24590

PCT Pub. Date: Jun. 11, 1998

Related U.S. Application Data

(60) Provisional application No. 60/032,176, filed on Dec. 4, 1996.

(51) Int. Cl.[7] ..... B24B 49/00

(52) U.S. Cl. ..... 451/6; 451/5

(58) Field of Search ..... 451/5, 6, 8, 11, 451/22, 49, 182

(56) References Cited

U.S. PATENT DOCUMENTS 5,480,342 * 1/1996 Bannayan et al. ..... 451/5
5,746,644 * 5/1998 Cheetham ..... 451/6

* cited by examiner

*Primary Examiner*—Timothy V. Eley
*Assistant Examiner*—Dung Van Nguyen
(74) *Attorney, Agent, or Firm*—John F. Reilly

(57) ABSTRACT

A method and apparatus for centerless grinding of one or more tapered sections in a length of wire in which the wire is advanced through a gap formed between a rotating work wheel and regulating wheel, and the gap is adjusted in forming the tapered section by an image detection module upstream of the wheels made up of a linear array of closely spaced pixels beneath a guide slot through which the wire is advanced to sense the position of the wire at close increments and incrementally adjust the gap in strict accordance with the position actually sensed.

25 Claims, 7 Drawing Sheets

METHOD AND APPARATUS FOR CENTERLESS GRINDING

CROSS REFERENCE TO RELATED APPLICATION

This application claims the benefit of Provisional Ser. No. 60/032,176, filed Dec. 4, 1996 for METHOD AND APPARATUS FOR CENTERLESS GRINDING, by Louis Archilla and owned by the assignee of the present application.

SPECIFICATION

This invention relates to centerless grinding systems; and more particularly relates to a novel and improved control system for a centerless grinding machine in producing specific profiles or tapers in a workpiece.

Centerless grinding machines are used to grind the outer surface of a rod or wire to specified dimensions and surface finish. In a typical grinding operation, a straight length of wire is fed between two grinding wheels which rotate in the same direction at different speeds and which are separated at the point of tangency by a distance equal to the diameter of the finished product. The work wheel or grinding wheel is fixed and rotates at a higher speed than a regulating wheel, the latter being moved toward or away from the work wheel in a straight line and locked in place. When one end of the workpiece, or wire, is fed between the two wheels, it is caused to rotate as a result of contact with the regulating wheel and is ground due to the action of the higher speed work wheel against the outer surface. Customarily, the regulating wheel is tilted with respect to the rotational axis of the work wheel so that its rotational axis is aligned at an angle, referred to as the "tilt angle", away from the rotational axis of the work wheel. Typically, the tilt angle is on the order of 1° to 3° and produces a resultant force component that causes the wire to move or be advanced in a linear direction between the wheels as it is being ground. The rate of advancement of the wire, or feed rate, basically is a function of the tilt angle as well as the regulating wheel speed and diameter. However, other external factors have a pronounced effect on the feed rate including the type and amount of coolant used, ambient temperature and humidity, type of wheel, wire material, diameter and uniformity as well as the amount of material removed. Accordingly, the feed rate may vary in an uncontrollable manner by 50% or more.

In the case of grinding a wire to a single diameter, the variations in feed rate become immaterial because a controlling factor is the gap between the two wheels which remains constant throughout the entire process. However, in profile grinding, such as, where one or more tapered sections are to be formed in the wire, there is an even greater tendency to undergo uncontrolled variations in feed rate due mainly to the added factor of regulating wheel spacing or retraction.

In the past, trial and error has been employed in which a slippage factor is combined with the conventional feed rate calculation to obtain a more realistic value of average velocity; however, this method requires constant monitoring of produced parts and periodic corrections to the regulating wheel rotational speed and spacing in order to obtain a close approximation to the desired profile. Another approach is disclosed in U.S. Pat. No. 5,480,342 to Bannayan et al in which both the position and feed rate of the wire are monitored by photoelectric cell detectors at widely spaced intervals along the bed, relatively speaking, and that information used to determine when the distance between grinding wheels should be changed and the rate at which that distance should be changed. Nevertheless, this approach presents numerous problems with respect to reliability of reading the movement of the wire past a photoelectric cell, the relatively wide spacing between cells and lagging and positioning errors which can result.

Another representative centerless grinder is disclosed in U.S. Pat. No. 5,674,106 to Cheetham in which photoelectric cells are utilized to sense the position and feed rate of the wire, the cells being mounted in slidable sensor banks which can be adjusted according to the length of the wire being ground but must calculate the actual position of the trailing end of the work piece between successive cells and compared to ideal position data to achieve the desired accuracy in the machined work piece profile.

The foregoing and other problems can be overcome by utilizing a position based system which is virtually feed rate independent in achieving the precise grinding of profiles having varying diameters with a high degree of accuracy. In particular, accuracy in grinding profiles is greatly enhanced by being able to calculate incremental changes in the gap based on the actual or known position of the work piece and not have to extrapolate between known positions or utilize trial and error in forming the desired profile.

SUMMARY OF THE INVENTION

It is therefore an object of the present invention to provide for a novel and improved method and apparatus for centerless grinding which is capable of accurately forming selected profiles in elongated articles, such as, wire.

Another object of the present invention is to provide for a novel and improved detection module for centerless grinding for accurately controlling incremental movement between a work wheel and regulating wheel in accordance with a specific profile to be ground.

It is a further object of the present invention to provide for a novel and improved method and means for centerless grinding of one or more tapered sections in a wire utilizing a position- based detection module to accurately control incremental changes in the gap formed between the grinding wheels in a highly efficient and dependable manner; and wherein the spacing between image detectors in a linear array for sensing the position of a wire as it is advanced along the linear array is such that each incremental movement of the grinding wheels in adjusting the gap therebetween is effected only in response to advancement of the wire past an image detector.

Broadly, in accordance with the present invention, there is provided an apparatus for grinding one or more tapered sections in a length of an elongated article by advancing the article axially through a gap formed between a rotating work wheel and rotating regulating wheel during a grinding cycle in which the gap is adjustable according to the diameter to which the article is to be ground, the improvement comprising drive means for rotating the wheels at a constant rate of speed during each grinding cycle, signal responsive means for incrementally adjusting the gap in a radial direction relative to axial advancement of the article through the gap, image detecting means upstream of the wheels through which the article is advanced including a series of image detectors for generating a succession of input signals in response to advancement of a trailing end of the article thereacross, and gap control means for generating and transmitting a plurality of output signals to the signal responsive means wherein each of the output signals is generated in response to receiving a series of input signals from the image detector means.

In a preferred form of the present invention, a novel and improved image detection module is placed in the path of advancement of the wire and in predetermined relation to the work wheel and regulating wheel to control a specific profile to be ground in the wire solely in response to sensing the position of the wire as it advances through the module. The module itself is in the form of a light chamber having a directed light source and image sensing linear array with a resolution of 200 pixels per inch or better, the array being of a length at least equal to that of the taper or profile being ground. Specifically, the module provides real time information to a central processing unit of current wire position which information is then used to command a stepper motor to move a previously computed number of steps at a selected constant speed. Since the regulating wheel motion takes place only after a confirmation signal is received that the wire has traveled a selected or programmed increment, the fact that each signal takes more or less time than the previous one becomes immaterial.

DETAILED DESCRIPTION OF PRESENT INVENTION

Figure 1:
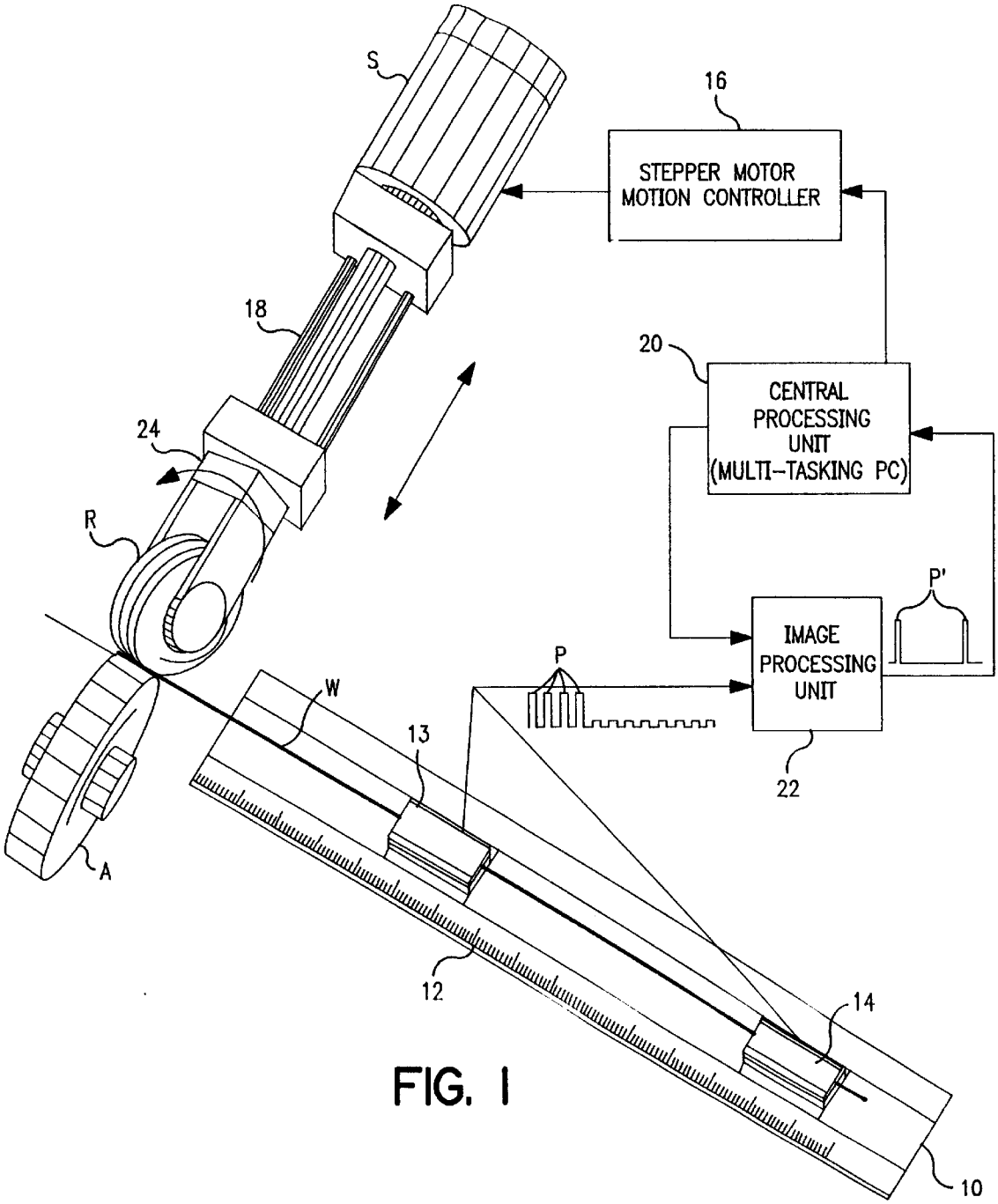
FIG. 1 is a schematic view of a preferred form of invention having a pair of detection modules for grinding a pair of tapered sections in a wire.

Referring in more detail to the drawings, there is shown in FIG. 1 a rod or straight wire W that is to be ground to specified profiles by placing upon a feed bed 10 having a graduated scale 12, and a pair of detection modules 13 and 14 are mounted on the feed bed 10 and advanced into predetermined spaced relation to one another and locked into position by suitable means on the feed bed. The feed bed 10 is located in predetermined spaced relation to a conventional work wheel A and regulating wheel R employed in centerless grinding operations, the detection modules 13 and 14 being placed and locked at specific locations on the feed bed to determine where the tapered sections are to be formed in the wire W as it is advanced through the gap formed between the work wheel A and regulating wheel R.

A stepper motor S includes a motion controller 16 which incrementally controls the spacing of the regulating wheel R with respect to the work wheel A through a rotary-to-linear motion device 18, the stepper motor being regulated by a central processing unit (CPU) 20 which receives signals from the detection modules 13 and 14 via image processing unit 22.

Before an actual grinding operation is initiated, information on the desired profile to be formed in the wire is entered into the CPU 20 via a system keyboard, mouse or other well-known means of computer data entry. These values are taken from a parts drawing or specification sheet. The computer program may be a graphically oriented program, such as, MicroSoft Visual Basic, Visual C, or other well-known computer programming methods. Once profile data is entered, the computer program will calculate optimum values of travel increments and corresponding regulating wheel retraction steps for each of the profiles and stores this data in specific registers for further use in a manner to be hereinafter described in more detail.

Figure 4:
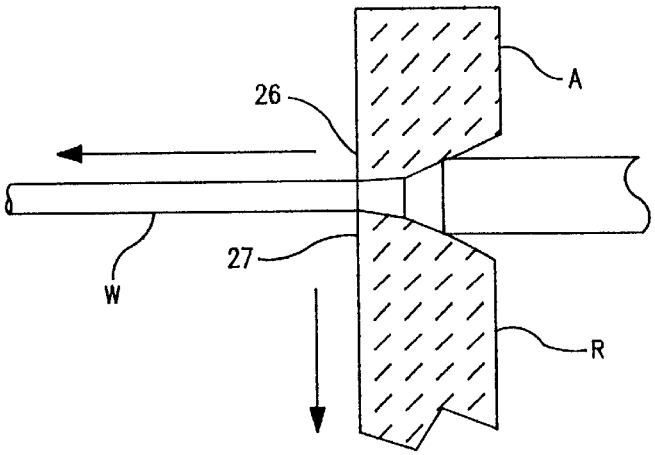
FIG. 4 is a somewhat schematic view illustrating the interrelationship between a work wheel and regulating wheel in grinding a tapered section in a wire.

In accordance with well-known practice in the centerless grinding art, the work wheel A and regulating wheel R rotate in the same direction but at different speeds. The work wheel A is generally larger in diameter than the regulating wheel and rotates at a constant speed substantially greater than that of the regulating wheel; and together with the granular composition of the wheels allows the work wheel A to remove material from the wire W by a grinding action while the regulating wheel R forces the wire W to spin under frictional force. A rotational support mechanism 24 at one end of the rotary-to-linear motion device 18 enables tilting of the regulating wheel R to a specified tilt angle, normally between 1° and 3°, to exert a tangential force component on the wire W which makes it travel in the direction of tilt at a speed based on regulating wheel speed and diameter, angle of tilt, and other nonquantifiable factors including temperature, humidity, coolant rate and type, wire diameter, wire material and uniformity and amount of material removed. More specifically, the tilt angle is that angle established by rotating the wheel R about an axis transverse to its rotational axis and causing its rotational axis to rotate or tilt upwardly with respect to the rotational axis of the work wheel typically on the order of 1° to 3°. FIG. 4 illustrates the confronting surfaces 26 and 27 between the work wheel A and regulating wheel R in grinding the wire W and in forming the desired profile under the control of the CPU 20 as the wire is advanced therethrough.

Figure 2:
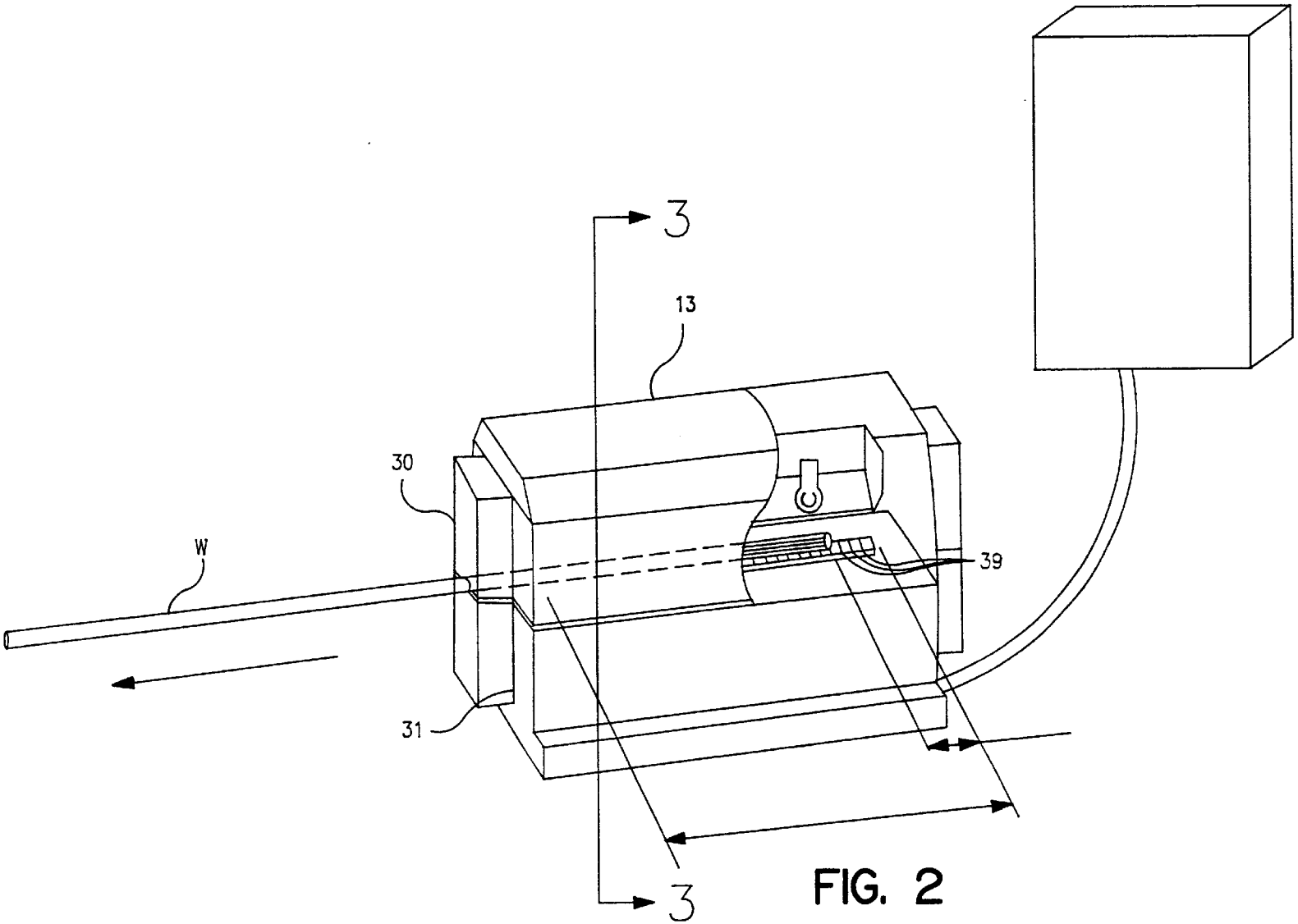
FIG. 2 is a somewhat perspective view of a preferred form of detection module in accordance with the present invention.
Figure 3:
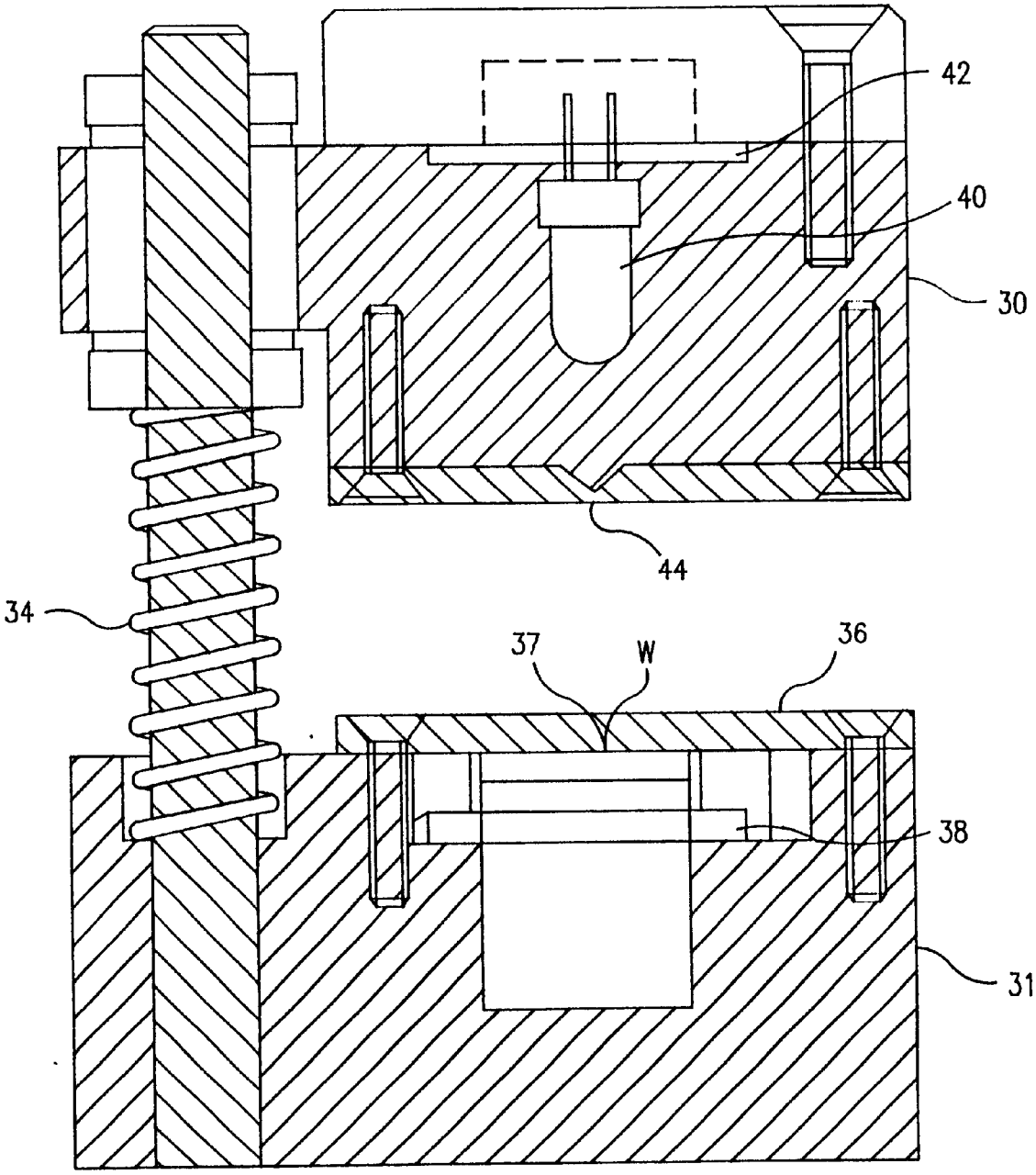
FIG. 3 is a cross-sectional view taken about lines 3—3 of FIG. 2 but illustrating the upper and lower halves of the detection module in an open position.
Figure 5:
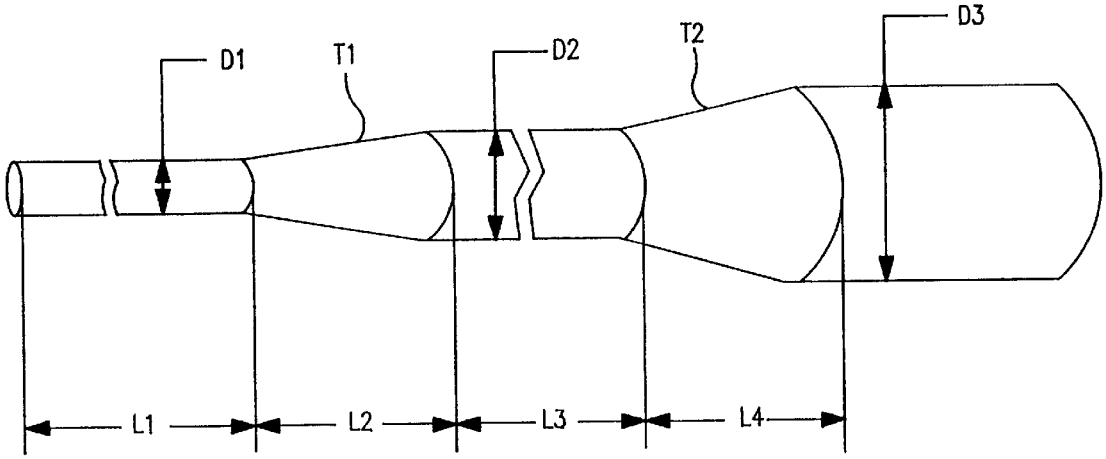
FIG. 5 illustrates the profile of a wire having a pair of tapered sections ground therein.

In order to form tapered sections, such as, tapered sections $T_1$, and $T_2$ as illustrated in FIG. 5, each detection module 13 and 14 is correspondingly comprised of an elongated chamber made up of upper and lower halves 30 and 31, the upper half 30 being movable between a raised open position, as shown in FIG. 3, and a lowered closed position as shown in FIG. 2 by any suitable support means as represented at 34 in the form of a spring-loaded, upstanding post member. The lower half of the chamber includes an upper wire support table 36 with an upwardly facing, longitudinally extending wire guide slot 37 to receive a wire W to be ground, and a linear imager array detector 38 is positioned beneath the support table 36 such that the wire is advanced in vertically spaced relation to the center line of the array 38. Preferably, the array 38 is made up of a plurality of pixels 39 arranged in juxtaposed relation to one another. One such array is Model TLS 218 manufactured and sold by Texas Instruments of Dallas, Tex. and, in the preferred embodiment, for an overall length of array of 2.5", 512 pixels 39 define discrete photo-sensing image detectors with typical dimensions of about 0.005" wide by approximately 0.003" long placed on a straight line at a spacing of 200 pixels per inch.

When light energy strikes a pixel, a charge is generated and stored for each cell, the amount of charge accumulated being directly proportional to the amount of incident light. The control electronics in the image processing unit 22 is able to read the amount of stored charge for each pixel in a particular sweep and to quantify the amount of light striking each pixel at the time of interrogation. This information is used by the image processing unit 22 to perform auto calibration cycles to adjust the array 38 to the type of light available. A light source 40 is mounted in the upper half 30 of the chamber and, for example, may be made up of a plurality of LEDs or light bulbs which produce light of wave lengths consistent with the sensors used. The light chamber has a reflector 42 at the top and an adjustable slit 44 at the bottom through which light is directed across the path of the wire guide slot 37 and the array 38, the slit 44 operating to focus a narrow column of light directly over the line of sensors or pixels 39 in the lower half. The wire W is restricted to advance through the guide slot 37 between the light column and linear array 38 so that it blocks light or casts a shadow over the covered sensor elements or pixels. As the trailing end of the wire W passes over each pixel or sensor 39, a signal is generated which will accurately reflect the position, or traveled distance, of the trailing end of the wire W from the entrance end of the array 38 over which the wire W is advanced. As the wire W advances continuously along the slot 37, it will therefore effectively generate a series of pulses as designated at P in FIG. 1 which are entered into the image processing unit 22.

When the number of successive pulses generated by the array 38 matches that of a programmed set point to be hereinafter described, an output pulse P' is generated and transmitted to the CPU 20 to send a command via line 19 to the stepper motor controller 16. The controller 16 is activated to incrementally advance the rotary-to-linear motion device 18 to retract the regulating wheel R one increment. This action is repeated as the wire W advances through the module 13 or 14 until the entire length of the tapered section T1 or T2 is formed.

Figure 6:
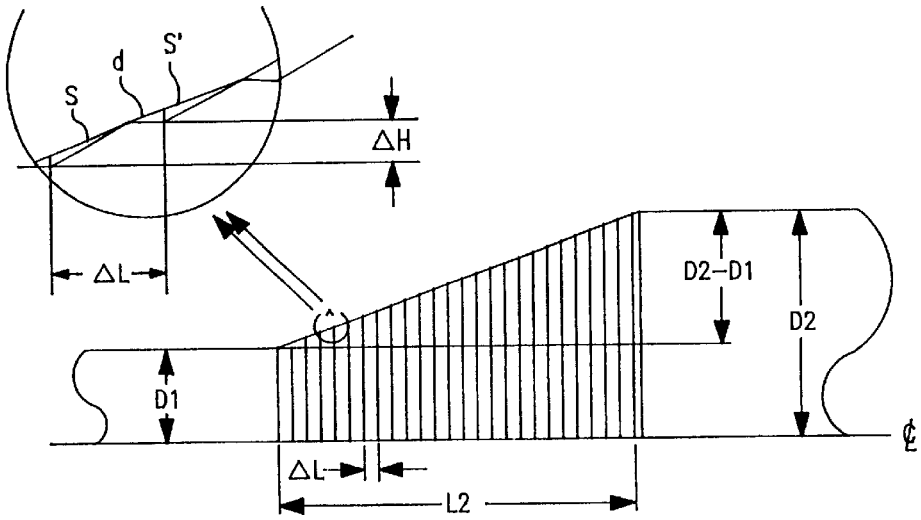
FIG. 6 is a schematic view illustrating in more detail the profile geometry of a single tapered section of wire subdivided into longitudinal and vertical increments.

Referring to FIG. 6, each incremental advancement of the regulating wheel is represented at Delta H over an incremental taper length represented as Delta L, it being understood that the taper is actually formed or defined by a progressive increase in diameter of the wire W from diameter $D_1$ to $D_2$. The sloped line S is the taper formed by the work wheel A over each incremental Delta L as the wheel spacing is increased by Delta H, following which there is a momentary dwell period represented at d when the next successive signal P' is processed and transmitted by the CPU 20. Of course, the blow-up of FIG. 6 greatly magnifies the dwell period and in fact is so minute as to be virtually imperceptible along the tapered section, bearing in mind that both FIGS. 5 and 6 are both on enlarged scales.

FIG. 5 represents a typical wire profile made up of lengths L1 and L3 of uniform diameter and tapered sections T1 and T2 over lengths L2 and L4, respectively. Thus, a wire of diameter $D_3$ is ground first to a diameter $D_1$ for a length of L1 at which point a taper is to be ground increasing the diameter from $D_1$ to $D_2$ along a taper length of L2, followed by a straight grind for a length of L3 after which a second taper is to be ground increasing the diameter from $D_2$ to $D_3$ along a taper length of L4. The image detection modules 13 and 14 are positioned and locked on the bed 10 at locations which coincide with the tapered sections T1 and T2 and such that the first pixel of each array 38 coincides with the start of the transition point for each tapered section T1 and T2. The arrays 38 are of a total length equal to or longer than the length of each tapered section T1 and T2 so that the effective length of each array 38 corresponds to the entire taper length of each respective tapered section T1 and T2.

Figure 8:
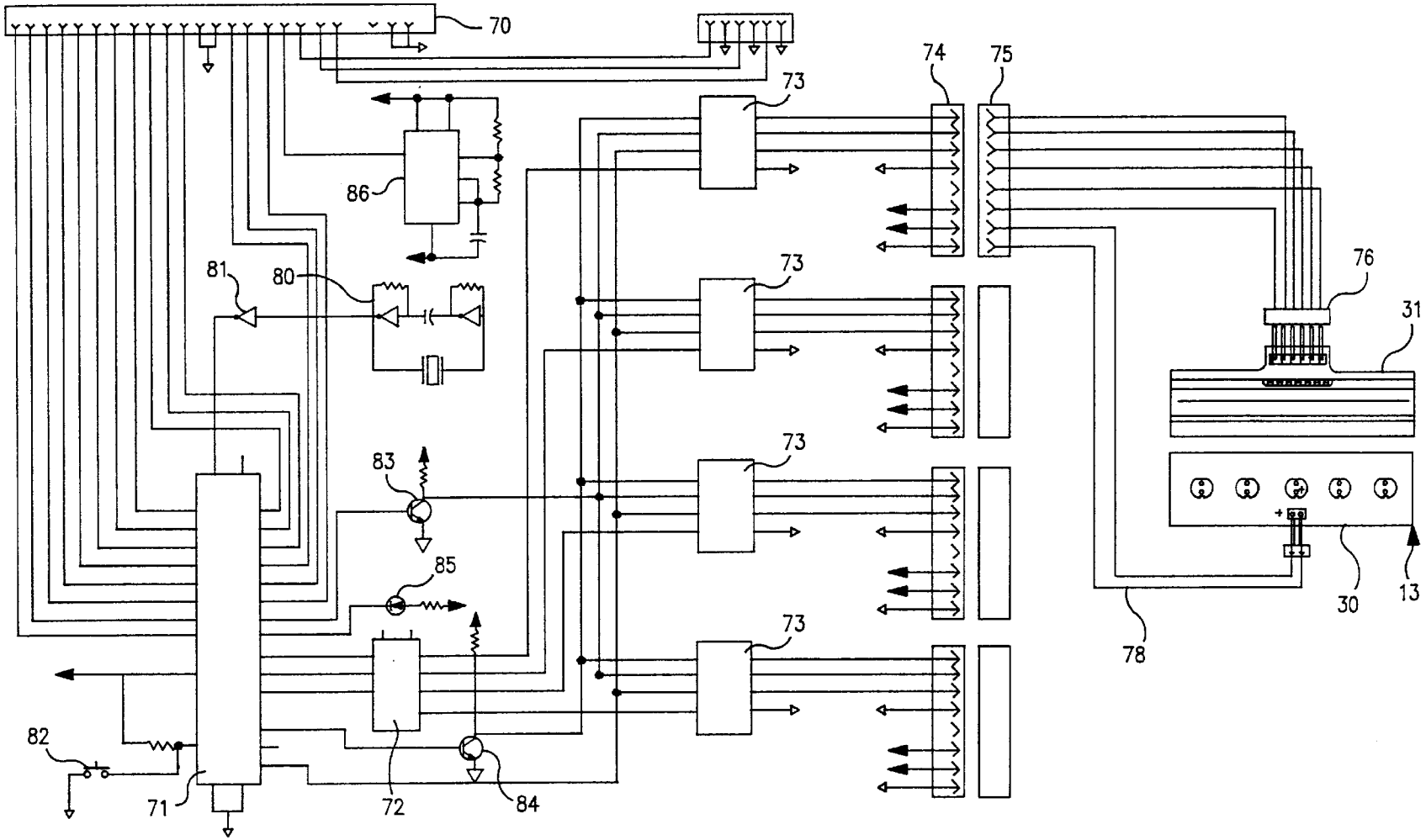
FIG. 8 is a schematic diagram of a suitable control circuit utilized in association with the image detection modules.

For the purpose of illustration but not limitation, there is schematically illustrated in FIG. 8 the control circuit for each of the detector modules 13 and 14, only one of the modules 13 being illustrated. A microcontroller 71 suitably may be a Model PIC16C73 of Microchip Technologies of Chandler, Ariz. or other commercially available single-chip microcontroller which are programmable devices that maintain the programmable control in non-volatile type of memory. An oscillator circuit represented at 80 and inverter 81 are connected to the input of the microcontroller 71 and a reset switch is represented at 82. Suitable power transistors 83 and 84 along with a status indicator LED 85 are provided on the output side of the microcontroller, the transistors 83 and 84 serving to interconnect the microcontroller 71 and decoder circuits 73 to which a common decoder 72 is connected through common lines from the microcontroller 71. The common or main decoder 72 is a 74LS139 chips and the decoder circuit 73 may be 74 LS243 chip produced by National Semiconductor Corporation of Santa Clara, Calif. or by other interchangeable source. Again, only a single detection model 13 is illustrated although the circuit is designed to communicate with up to four different modules corresponding either to module 13 or 14 of the present invention by wiring to the remaining three decoder circuits 73. In this case, the module 13 is wired to the uppermost decoder circuit illustrated in FIG. 8 via multi-line mating connectors 74 and 75, such as, Model WMLX-106 produced by Waldom Electronics, Inc. of Chicago, Ill. A multi-wire cable 76 and connectors 78 are used to provide power and signals to the linear array housed in the lower half 31 of the module 13 and to the light sources 40 at the upper half of the module 13.

Another dedicated connector 70 of the same type as connector 74 is provided to communicate with the multi-tasking computer 20, FIG. 1, in a bidirectional manner, and a pulse generator 86 produces a timing signal for the connector 74 in a well-known manner.

Figure 9:
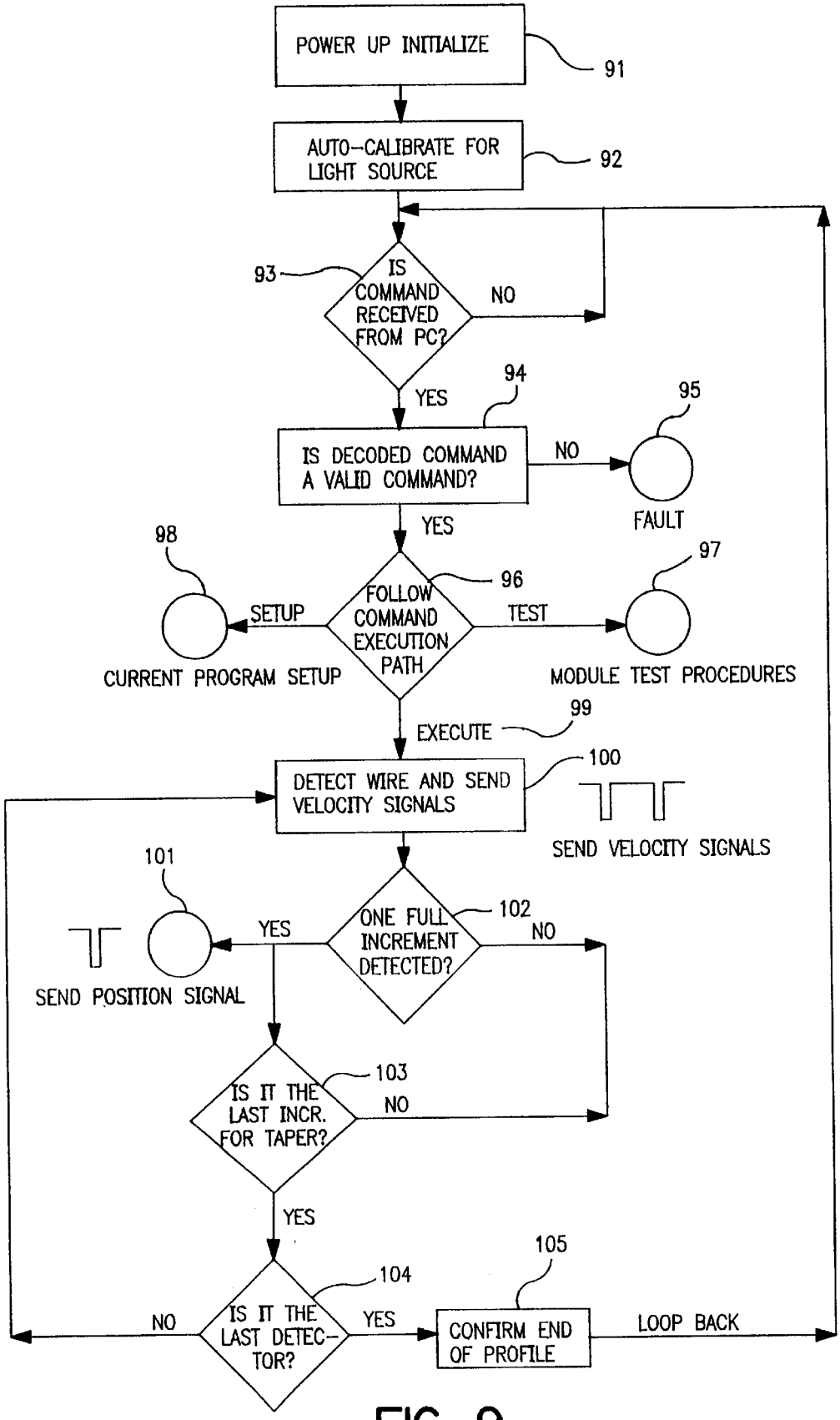
FIG. 9 is a flow chart of the routines followed by the control circuit of FIG. 8.

The flow chart of FIG. 9 illustrates the various routines performed in the image processing unit 22 in receiving pulses P from a detection module, such as, the detection module 13 and transmitting in the form of pulses P' at predetermined time intervals to the central processing unit or multi-tasking PC 20.

The flow chart of FIG. 9 illustrates the procedure followed by the image processing unit 22 and its software in sensing pulses P received from the linear array 30 in response to movement of the wire and converting into pulses P' after the wire has advanced over a predetermined number of pixels 39. At Power-up Initialize 91, the control circuit for the image processing unit 20 is initialized and goes into Auto-calibration routine at 92 to determine the ability of the detectors 39 to store a charge of energy directly proportional to the strength of the incident light. In response to a command received at 93 from the CPU 20, a determination is made at 94 whether a valid command is received; if non-valid, the controller 71 goes into a fault status as at 95. If valid, the program may then follow one of three options, namely, Execute Mode 96, Test Mode 97 or Set-up Mode 98. The test mode basically validates the correct functioning of each detection module 13, 14 and calibrates the internal registers used when performing taper operations. The Set-up Mode 98 is performed in conjunction with the main control program for a specific profiling program so that the controller 71 knows how many detectors 39 are to be used and in what order they are going to be scanned during profiling.

In the Execute Mode 96, the controller 71 starts scanning the first pixel 39 of the first module 13 in order to determine the exact instant when the trailing end of the wire being ground permits light to pass and strike the first pixel 39 in that detector module. At that instant, a signal is sent to the main computer 20 in the form of a pulse P' followed by a second pulse P' once the wire has traveled a predetermined length expressed in terms of the number of pixels successively exposed by the wire. These two signals or pulses P' are used by the CPU 20 to calculate the wire entry velocity V. This entry speed V is optimized by the main computer and then assumed to remain constant in order to calculate the corresponding constant retraction speed VH of the regulating wheel. Subsequent signals or pulses P' are sent each time that the wire travels a predetermined number of pixels consistent with the programmed set point for that partiuclar taper. The procedure is repeated in a loop for each one of the detectors 13, 14, etc. until the last pixel 39 of the last or final module. An end-of-cycle signal 104 is transmitted to the CPU 20 in response to the last increment at 103 and a confirmation of cycle completed signal is generated at 105 whereupon the image processing program will loop back to the command received routine 93.

Figure 7:
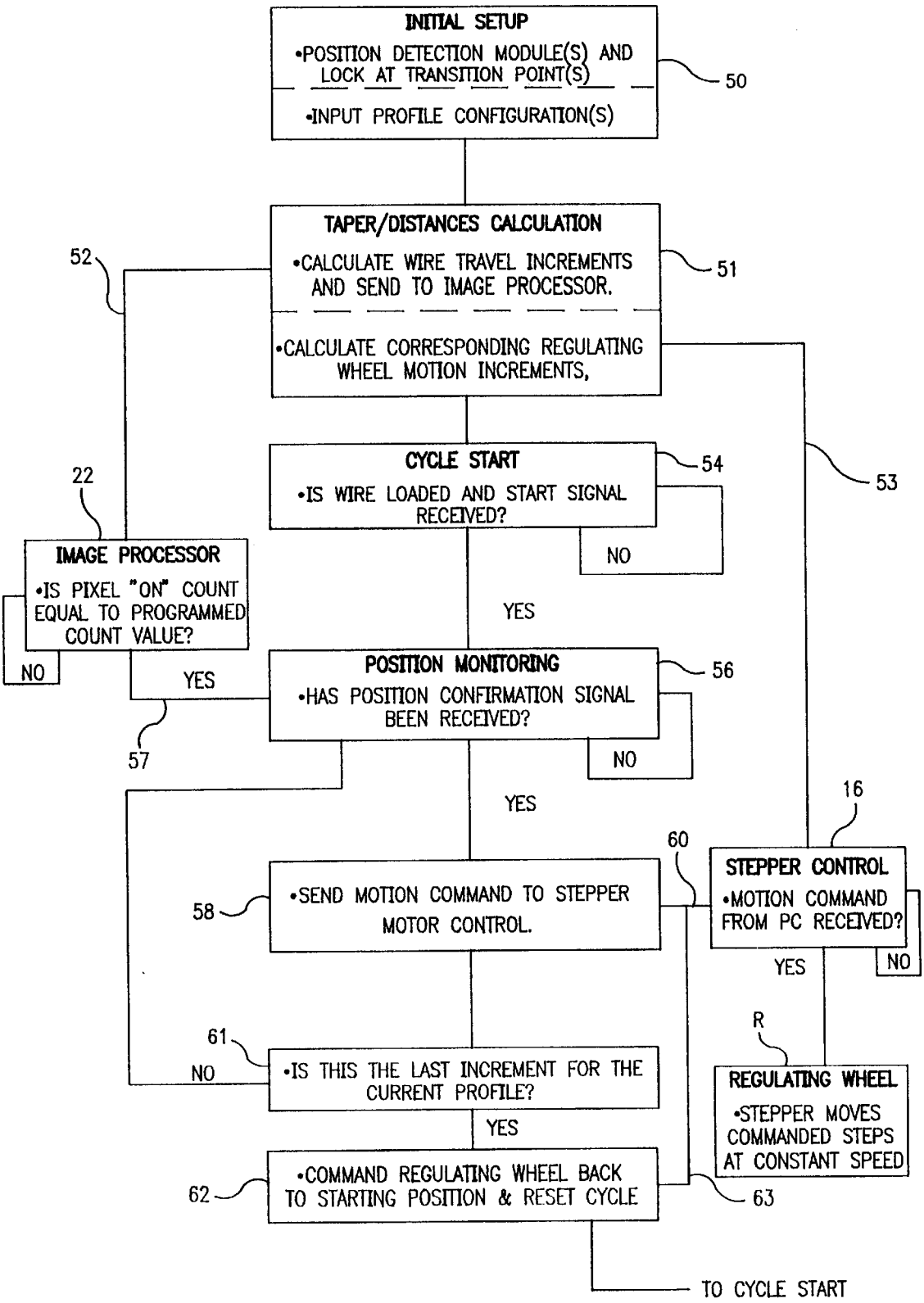
FIG. 7 is a flow chart illustrating the sequence of steps followed in centerless grinding of a tapered section into a wire in accordance with the present invention.

Referring to FIGS. 1 and 7, as represented at 50, Initial Setup is performed by advancing the detection modules 13 and 14 along the bed 10 and positioning with the assistance of the graduated scale 12 to correspond with the point at which the tapered sections T1 and T2 are to be formed in the wire as it is advanced through the work wheel A and regulating wheel R; and the modules 13 and 14 are locked in place once the correct position has been established. Input profile configurations are entered into the CPU 20 under the control of the computer program or any other known method of data entry. Basically, the operator is prompted to enter data in the form of L1, $D_1$, L2 ($D_1$–$D_2$), L3, L4 ($D_2$–$D_3$).

Once the data is entered at 50, the computer program proceeds to calculate the values for wire travel increments and corresponding stepper motor number of steps (travel distance) to control the motion of the regulating wheel R, as represented at 51, and sent via line 52 to the image processor 22. An optimum constant regulating wheel retraction speed is also calculated at this point and transmitted via line 53 to the stepper motor controller 16. These values are stored in specific memory registers and will be used during the taper grinding cycles in a manner hereinafter described.

As represented at 54, Cycle Start is initiated by loading a length of wire W into the grooves 44 of the detection modules 13 and 14 as previously described, and manually advancing the leading end of the wire into the tapered areas of the surfaces 26 and 27. This action will cause the grinding process to start and the wire to be pulled in the feeding direction over the detection module so that when the trailing edge is detected by the first pixel of module 13 a start signal is generated and sent to the CPU 20. As represented at 56, the CPU 20 receives the start signal and upon receipt of a pulse P' from the image processor 22 over line 57 will send a motion command to the stepper motor controller 16 as represented at 58 over line 60. The stepper control 16 will then activate the rotary-to-linear motion device 18 to retract the regulating wheel R one increment; i.e., increase the lateral spacing between the regulating wheel R and work wheel A one increment. Again, referring to FIG. 6, as the regulating wheel is advanced by the motion device 18 one increment it will cause an incremental increase in diameter of the wire along the sloped line S. The next pulse P' received will cause the regulating wheel to undergo another increase in lateral spacing so as to form the next incremental slope line S', and the process will repeat itself until the complete tapered section T1 has been formed in response to advancement of the trailing end of the wire W through the first detection module 14. As represented at 61, when the last pulse P' has been received from the linear array 38, a command is sent from the CPU as represented at 62 via line 63 back to the stepper control 16 as well as to Cycle Start 54. As the wire is continuously advanced without the receipt of motion commands from the stepper controller 16, the regulating wheel R will continue to grind the wire at the uniform diameter $D_2$, as shown in FIG. 5. Advancement of the trailing end of the wire W into the detection module 13 will then initiate another Cycle Start by transmittal of pulses P' from the image processing unit 22 in response to receipt of the pulses P from the detection module 13. Upon completion of the tapered section T2 the regulating wheel R will continue to grind in cooperation with the work wheel A along the diameter $D_3$.

It will be apparent from the foregoing that various types of logical circuitry as well as programmable control circuitry may be utilized to calculate the values for wire travel increments (Delta L) and regulating wheel travel increments (Delta H) for a given regulating wheel retraction speed (VH). Referring to FIGS. 5 and 6, assume that $D_1$ equals 0.005", $D_2$ equals 0.006" and L2 equals 1.000" for the first tapered section T1. In the linear array 38, the spacing between adjacent pixels 39 defines the minimum increment of wire travel which can be measured (MinL) and is 0.005" for the Model TLS 218. On the other hand, the minimum distance or lateral spacing that can be controlled by the rotary-to-linear motion device 18, or minimum incremental movement (MinH) of the regulating wheel is assumed to be 0.0001".

The number of increments (N) representing the number of times that the regulating wheel is advanced or spaced in forming the tapered section T1 is calculated using the formula:

$$N=L2/\text{Min } L \text{ or: } N=1.000/0.005=200$$

The first value for N is then used to calculate the regulating wheel increments (Delta H):

$$\text{Delta } H=(D_2-D_1)/N \text{ or: Delta } H=(0.006-0.005)/200=0.000005"$$

It will be evident that Delta H must be equal to or greater than MinH, but in the above it will be seen that Delta H is much less than MinH. Accordingly, the number of increments (N) must now be calculated using the formula:

$$N=D_2-D_1/\text{Min } H \text{ or: } 0.006-0.005/0.0001=10$$

Referring again to FIG. 6, the motion increments are calculated as follows:

$$\text{Delta } L=L2/N \text{ or: Delta } L=1.000/10=0.100" \text{ Delta } H=D_2-D_1\backslash N \text{ or Delta } H=0.006-0.005/10=0.0001"$$

The regulating wheel constant speed value VH is calculated assuming, for example, a constant linear speed of the wire of 1.00 inch per second which, for ten increments (N) breaks down into 0.100 second for each increment and $$VH=\text{Delta } H/\text{time per increment or } VH=0.0001/0.100=0.001 \text{ inch per second}$$

As noted previously, the minimum stepper motor increment (MinH) imposes a limit on the number of computed wire travel increments (Delta L), or number of pixels, that must be traversed by the trailing end of the wire to constitute one increment (N). Accordingly, the number of pixels (N/P) is determined as follows:

$$N/P = \text{Delta } L/ML \text{ or } N/P = 0.100/0.005 = 20$$

Thus, the image processing unit 22 will generate an output pulse P' each time that the trailing end of the wire traverses twenty successive pixel elements. The calculated values for Delta H and VH are transmitted to the stepper motor controller 16 so that when the controller 16 receives motion commands from the CPU 20 it will move the regulating wheel by Delta H increments at a constant speed of VH. As seen from FIG. 6, for each incremental length of travel Delta L there is a corresponding lateral displacement Delta H. The actual path of the regulating wheel R follows very closely the specified profile, and optimum conditions are obtained when the number of increments (N) is maximized according to the calculations hereinbefore described.

Based on the foregoing, since the regulating wheel motion takes place only after a confirmation signal is received from the image processing unit 22 that the wire has traveled the computed distance, the fact that this action takes more or less time is immaterial and the feed rate is not a factor. It is therefore to be understood that while a preferred form of invention is herein set forth and described, the above and other modifications and changes may be made therein without departing from the spirit and scope of the invention as defined by the appended claims and reasonable equivalents thereof.

I claim:

1. In apparatus for grinding one or more profiles in a length of an elongated article by advancing said article axially through a gap formed between continuously rotating work and regulating wheels during a grinding cycle in which said gap is adjustable according to the diameter to which said article is to be ground, the improvement comprising:

signal-responsive means for incrementally adjusting said gap in a radial direction relative to axial advancement of said article through said gap;

image detecting means upstream of said wheels through which said article is advanced including a series of image detectors for generating a succession of input signals in response to advancement of a trailing end of said article thereacross; and gap control means for generating and transmitting a plurality of output signals to said signal-responsive means wherein each of said output signals is generated in response to receiving a predetermined number of input signals from said image detecting means independently of the rate of axial advancement of said article.

2. In apparatus according to claim 1 wherein said signal-responsive means is operative to adjust said gap a predetermined number of radial increments (N) progressively in an outward radial direction (Delta H) in forming at least one tapered profile.

3. In apparatus according to claim 2 wherein said signal-responsive means is operative to adjust said gap in an outward radial direction at equally spaced lengthwise increments (L) along the full length of said profile.

4. In apparatus according to claim 3 wherein said article is wire and said series of image detectors is defined by pixels at a spacing on the order of 0.005", each of said input signals being generated in response to passage of a trailing end of said wire across each respective said pixel, and said gap control means generating each of said output signals at spaced intervals corresponding to said lengthwise increments (L), the maximum number (N) of said lengthwise increments (L) being equal to the difference in diameter of said wire at opposite ends of said tapered section divided by the minimum incremental distance that said signal-responsive means is capable of moving (Min H).

5. In apparatus according to claim 4 wherein said wire advances along an elongated slot in said image detection means, said slot being interposed between a light source and said series of image detectors.

6. In apparatus according to claim 5 wherein said series of image detectors is defined by a linear array of pixels intercepting light passing through said slot from said light source.

7. In apparatus according to claim 5 wherein said light source includes a reflector and an adjustable slit through which light is directed across the path of said slot and said array.

8. In apparatus according to claim 7 wherein said image detection means includes an elongated chamber made up of upper and lower halves movable into and away from closed relation to one another, said slot extending along said lower half of said chamber and said series of image detectors disposed beneath said slot.

9. In apparatus according to claim 8 wherein said light source is disposed in said upper half of said chamber.

10. In apparatus according to claim 5 wherein said image detection means includes a module housing said series of image detectors for each said tapered section to be formed in said wire and means for adjusting the spacing between said module and said wheels.

11. In apparatus according to claim 1 wherein said gap control means includes a stepper motor, said input signals are electronic signals, and computer programmable means associated with said image detecting means for receiving said input signals and sending commands to said stepper motor at equally spaced intervals defined by dimensional data previously entered and stored in said computing means which define the desired dimensions of said profiles.

12. In apparatus according to claim 1 wherein said image detecting means includes a plurality of image detection modules of a length at least equal to the longitudinal dimension of said profile, each of said modules having a lower image detection chamber, an intermediate adjustable article-guiding elongated slot, and an upper light sourcing chamber.

13. In apparatus according to claim 12 wherein said lower detection chamber houses linear arrays of closely spaced pixels at a uniform spacing not to exceed 0.005" having individual outputs storing a readable charge proportional to the amount of incident light energy received.

14. In apparatus according to claim 13 wherein said article-guiding elongated slot is disposed at the center line of said linear array of pixels, said article being free to advance longitudinally and to rotate about its axis unopposed as it is pulled and made to spin by the action of said regulating wheel in conjunction with said grinding wheel.

15. In apparatus according to claim 12, said upper light sourcing chamber including a linear array of adjustable intensity light sources of a wave length consistent with said pixels, said chamber positioned directly above said pixels and said slot and movable to permit loading of said articles into said slot.

16. In apparatus according to claim 15, said light sourcing chamber including means for adjusting light intensity in accordance with the amount of charge produced on said pixels for different types of said articles.

17. In apparatus for grinding one or more tapered sections in a length of an elongated wire by advancing said wire axially through a gap formed between continuously rotating work and regulating wheels during a grinding cycle in which said gap is adjustable according to the diameter to which said wire is to be ground, the improvement comprising:

signal-responsive means for incrementally adjusting said gap in a radial direction relative to axial advancement of said wire through said gap wherein said signal-responsive means is operative to adjust said gap a predetermined number of radial increments (N) progressively in an outward radial direction (Delta H) in forming at least one tapered section (T);

image detecting means upstream of said wheels through which said wire is advanced including spaced detection modules each having a series of image detectors for generating a succession of input pulses in response to advancement of a trailing end of said wire thereacross wherein said series of image detectors is defined by pixels, each of said input pulses being generated in response to passage of a trailing end of said wire across each respective said pixel; and gap control means for generating and transmitting a plurality of output pulses to said signal-responsive means wherein each of said output pulses is generated in response to receiving a predetermined number of input pulses from said image detecting means and wherein said signal-responsive means is operative to adjust said gap in an outward radial direction at equally spaced lengthwise increments (L) along the full length of said tapered section (T), and said gap control means generating said output pulses at spaced intervals corresponding to said lengthwise increments (L), the maximum number (N) of said lengthwise increments (L) being equal to the difference in diameter of said wire at opposite ends of said tapered section divided by the minimum incremental distance that said signal-responsive means is capable of moving (Min H).

18. In apparatus according to claim 17 wherein said wire advances along an elongated slot in said image detection means, said slot being interposed between a light source and said series of image detectors.

19. In apparatus according to claim 18 wherein said series of image detectors is defined by a linear array of said pixels intercepting light passing through said slot from said light source, and said light source includes a reflector and an adjustable slit through which light is directed across the path of said slot and said array.

20. In apparatus according to claim 19 wherein each detection module includes an elongated chamber made up of upper and lower halves movable into and away from closed relation to one another, said slot extending along said lower half of said chamber and said series of image detectors disposed beneath said slot.

21. In apparatus according to claim 20 wherein said light source is disposed in said upper half of said chamber.

22. The method of grinding one or more tapered sections in a length of an elongated wire by advancing said wire axially through a gap formed between rotating work and regulating wheels wherein said gap is adjustable according to the diameter to which said wire is to be ground and wherein signal-responsive means is provided for adjusting said gap, the steps comprising:

rotating said wheels at a constant rate of speed during each grinding cycle;

advancing said wire across a series of image detectors and generating a succession of input signals in response to advancement of the trailing end of said wire thereacross; and generating and transmitting an output signal to said signal-responsive means in response to receiving a predetermined number of said input signals; and adjusting the gap between said wheels independently of the rate of axial movement of said wire.

23. The method according to claim 22 including the step of adjusting said gap a predetermined number of radial increments progressively in an outward radial direction in forming at least one profile.

24. The method according to claim 23 characterized by adjusting said gap in an outward radial direction at equally spaced lengthwise increments along the full length of said profile.

25. The method of grinding according to claim 22 including the step of entering and storing dimensional data defining each of said profiles to be ground and calculating the inward or outward distance of movement required for said regulating wheel as said wire is advanced across said image detectors.

* * * * *